US009726378B2

(12) United States Patent
Ma

(10) Patent No.: US 9,726,378 B2
(45) Date of Patent: Aug. 8, 2017

(54) GAS BURNER WITH TILT SAFETY ASSEMBLY

(71) Applicant: Pro-Iroda Industries, Inc., Taichung (TW)

(72) Inventor: Wei-Cheng Ma, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 463 days.

(21) Appl. No.: 14/537,962

(22) Filed: Nov. 11, 2014

(65) Prior Publication Data

US 2016/0084505 A1 Mar. 24, 2016

(30) Foreign Application Priority Data

Sep. 18, 2014 (TW) ..... 103132233 A

(51) Int. Cl.

| | |
|---|---|
| ***F24C 3/12*** | (2006.01) |
| ***F23D 14/72*** | (2006.01) |
| ***F24C 1/16*** | (2006.01) |
| ***F24C 15/00*** | (2006.01) |
| ***F24C 3/14*** | (2006.01) |
| ***F23N 5/24*** | (2006.01) |

(Continued)

(52) U.S. Cl.

CPC ..... *F24C 3/126* (2013.01); *F23D 14/28* (2013.01); *F23D 14/72* (2013.01); *F23N 5/247* (2013.01); *F24C 1/16* (2013.01); *F24C 3/14* (2013.01); *F24C 15/001* (2013.01); *F23N 2031/14* (2013.01)

(58) Field of Classification Search

CPC .... F24C 3/126; F24C 1/16; F24C 3/14; F24C 15/001; F24C 3/12; F24C 3/122; F24C 5/16; F23D 14/28; F23D 14/72; F23N 2031/14; F23N 5/247; F23N 5/24

USPC ..... 126/42; 137/43, 45, 65

See application file for complete search history.

(56) References Cited

U.S. PATENT DOCUMENTS 2,240,277 A * 4/1941 Zoder ..... F16K 17/00 137/201

3,996,951 A * 12/1976 Parr ..... B08B 7/02 137/43

(Continued)

FOREIGN PATENT DOCUMENTS

TW M247795 U 10/2004

*Primary Examiner* — Kenneth Rinehart

*Assistant Examiner* — Alex Girard

(74) *Attorney, Agent, or Firm* — Alan D. Kamrath; Kamrath IP Lawfirm, P.A.

(57) ABSTRACT

A gas burner includes a gas reservoir, a combustion device, and a tilt safety device fluidly connecting to one another. The tilt safety device includes first and second seats including first and second gas passages respectively, an elastomer disposed on the second seat and including a section defining a stop, a control mechanism including a lever adjacent to the elastomer and including a first contact area and at least one second contact area selectively engaging with a pusher which engages with the stop, and a gas flow channel connecting to the second gas passage and a hole extending through the elastomer and the first gas passage and including the first and second ends thereof including the stop disposed therebetween. The first and at least one second contact areas space from the elastomer at first and second heights respectively. The second height is less than the first height.

16 Claims, 11 Drawing Sheets

(51) Int. Cl.
*F23D 14/28* (2006.01)
*F23D 14/06* (2006.01)

(56) References Cited

U.S. PATENT DOCUMENTS

| | | | | |
|---|---|---|---|---|
| 6,810,905 | B1 * | 11/2004 | Watson | F16K 21/18 137/15.26 |
| 9,506,647 | B2 * | 11/2016 | Ma | F23D 14/28 |
| 2014/0338660 | A1 * | 11/2014 | Kelly | F23C 13/06 126/85 R |

* cited by examiner

GAS BURNER WITH TILT SAFETY ASSEMBLY

BACKGROUND OF THE INVENTION

1. Field of the Invention

The present invention relates to a gas burner and, particularly, to a gas burner with tilt safety assembly.

2. Description of the Related Art

TW Patent No. M247795 shows a recreational lightweight and portable stove. The stove includes a connecting head connectable to a gas can. The connecting head includes an adjusting screw which controls gas output amounts. Moreover, the stove includes a guiding conduit and an adjusting ring sleeved on the guiding conduit. The guiding conduit includes a plurality of vents, and the adjusting ring includes a plurality of vents associated with those of the guiding conduit. The plurality of vents of the adjusting ring can correspond to those of the guiding conduit. A transit conduit interconnects the connecting head and the guiding conduit. Moreover, the stove includes a burner. The burner is supported by four footstands. Gas flows in the connecting head, the transit conduit, the guiding conduit, and the burner sequentially. However, the stove has no safety means, so it is dangerous if the gas can tips over.

The present invention is, therefore, intended to obviate or at least alleviate the problems encountered in the prior art.

SUMMARY OF THE INVENTION

According to the present invention, a gas burner with tilt safety assembly includes tilt safety assembly. The tilt safety assembly includes a combustion device connectable to a gas reservoir and including a communication pipe. The communication pipe includes a joint engagable with an outlet of the gas reservoir. The communication pipe has a first end connecting to the joint and a second end defining an exit end. The tilt safety assembly includes a tilt safety device fluidly connecting to the communication pipe. The tilt safety device includes a first seat including a first gas passage extending longitudinally along a phantom axis which extends in a vertical direction. The tilt safety device includes a second seat connecting to the second end of the communication pipe and bearing the first seat and including a second gas passage. The tilt safety device includes an elastomer disposed on the second seat and having a bottom edge adjacent to the second seat and a top edge distal to the second seat and including a section defining a stop extending between the top and bottom edges. The tilt safety device includes a control mechanism including a lever having a first end disposed adjacent to the top edge of the elastomer and a second end extending away from the phantom line and including a first contact area and at least one second contact area selectively engaging with a pusher which has an end engaging with the stop. The first contact area spaces from the top edge of the elastomer at a first height. The at least one second contact area spaces from the top edge of the elastomer at a second height which is less than the first height. The tilt safety device includes a gas flow channel extending between the second seat and the elastomer and having a first end connecting to the second gas passage and a second end connecting to a hole extending through the elastomer and the first gas passage and including the first and second ends thereof including the stop disposed therebetween.

The gas burner with tilt safety assembly in an operative position thereof stands in an upright position and includes the lever in a position that the first contact area engages with the pusher and the elastomer is free of deformation.

The gas burner with tilt safety assembly in an inoperative position thereof stands in a tilted position and includes the lever in another position that the at least one second contact area engages with the pusher and the elastomer deforms to abut the second seat and blocks the gas flow channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such-equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an object of the present invention to provide a gas burner with tilt safety assembly.

Other objectives, advantages, and new features of the present invention will become apparent from the following detailed description of the invention when considered in conjunction with the accompanied drawings.

DETAILED DESCRIPTION OF THE INVENTION

Figure 1:
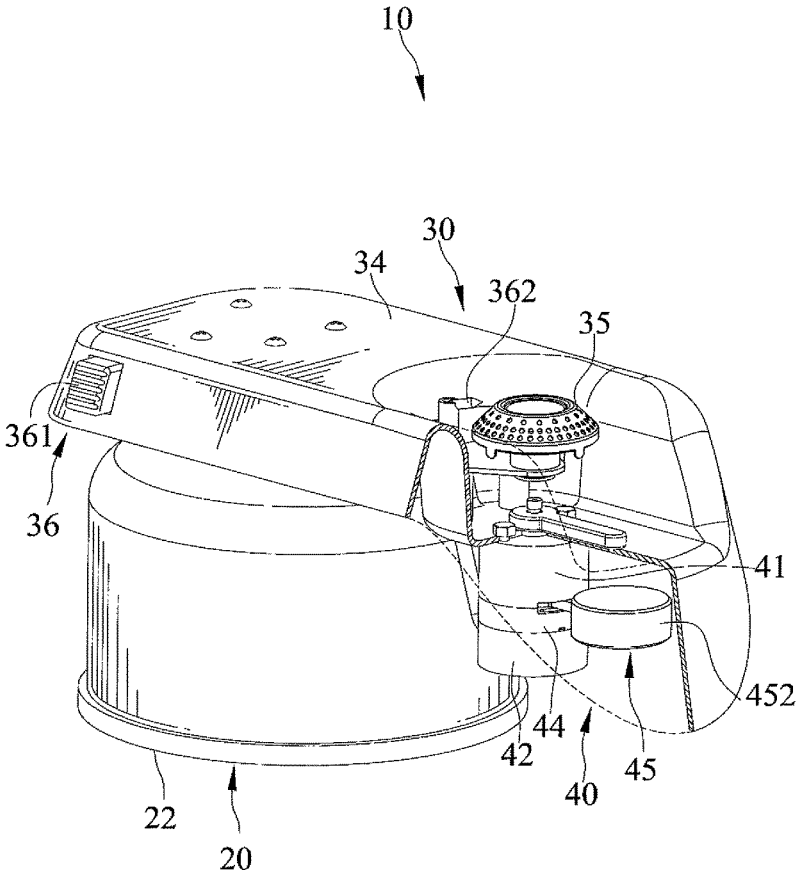
FIG. 1 is a perspective view of a gas burner with tilt safety assembly in accordance with the present invention.
Figure 2:
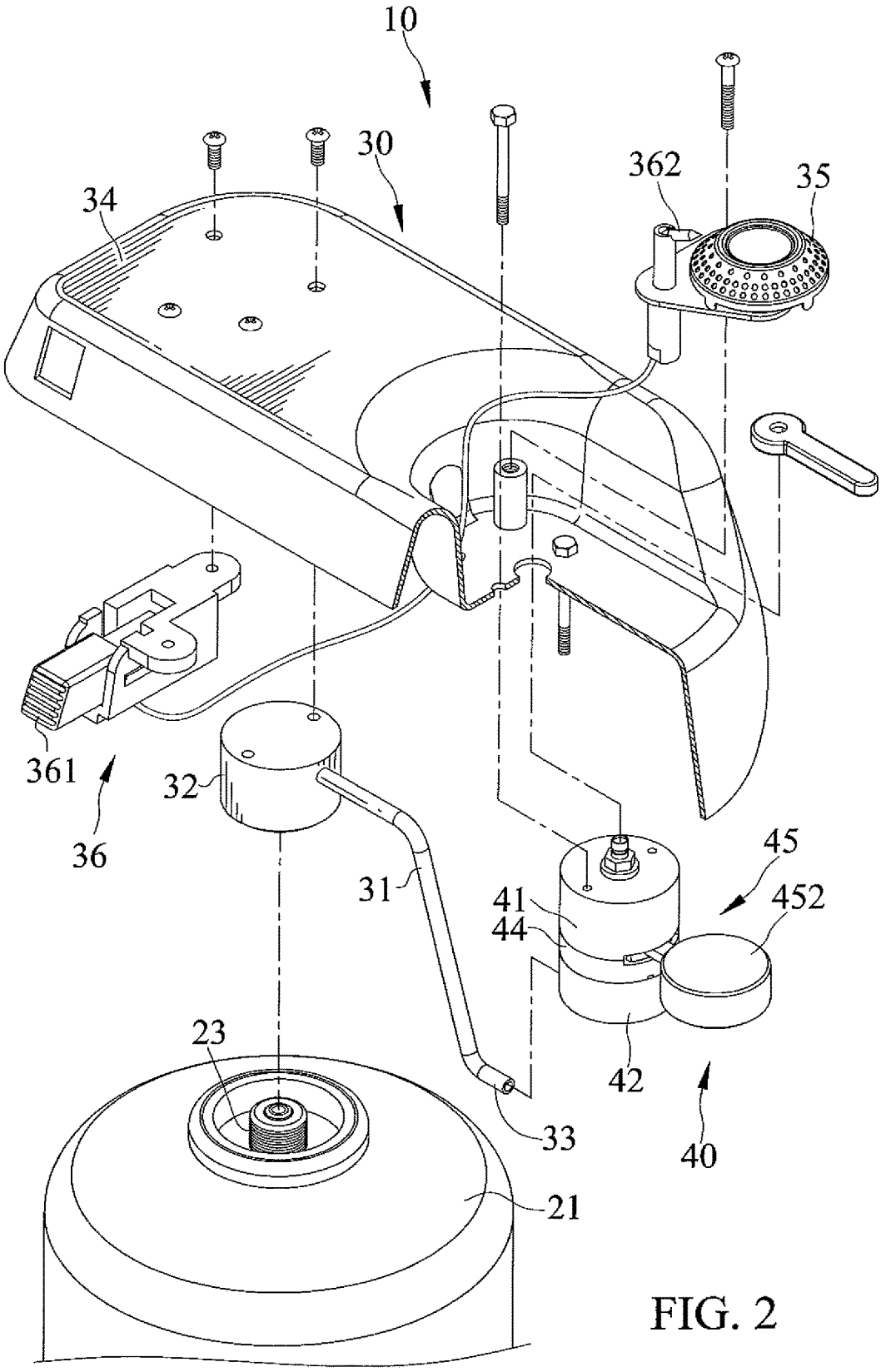
FIG. 2 is an exploded perspective view of the gas burner with tilt safety assembly of the present invention.
Figure 3:
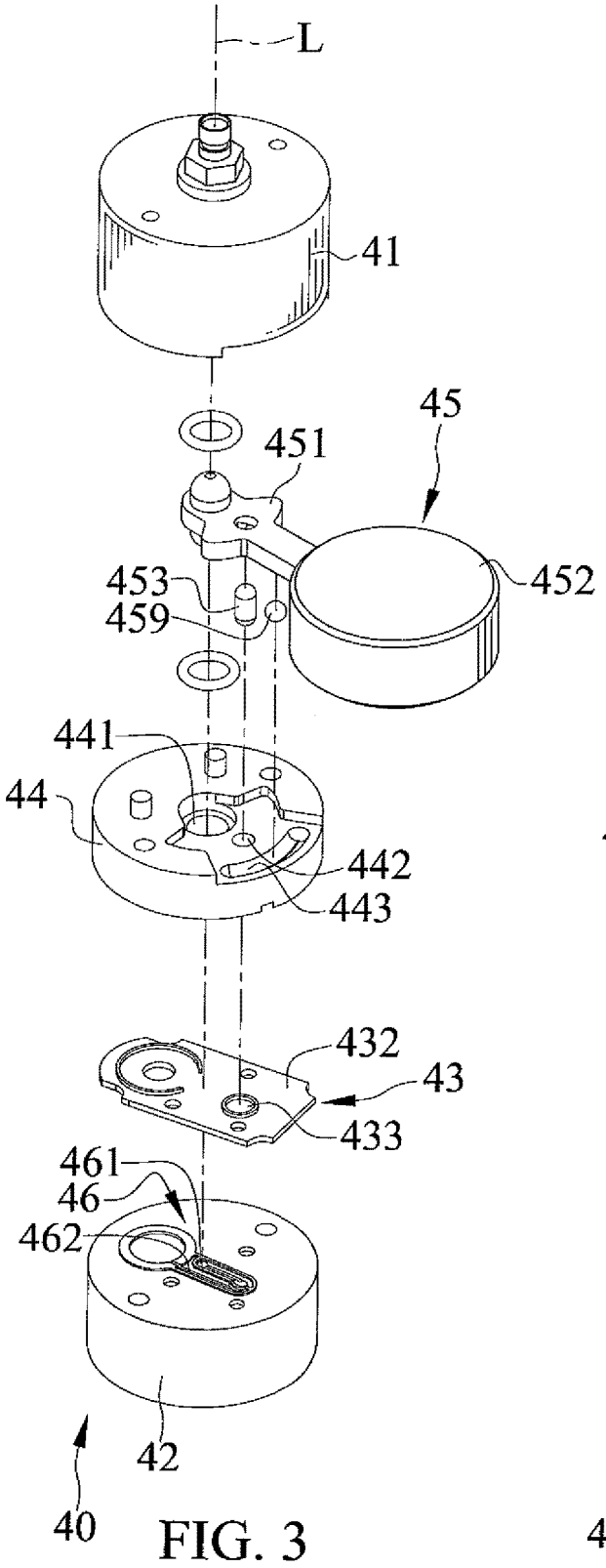
FIG. 3 is an exploded perspective view of the tilt safety device of the present invention.
Figure 4:
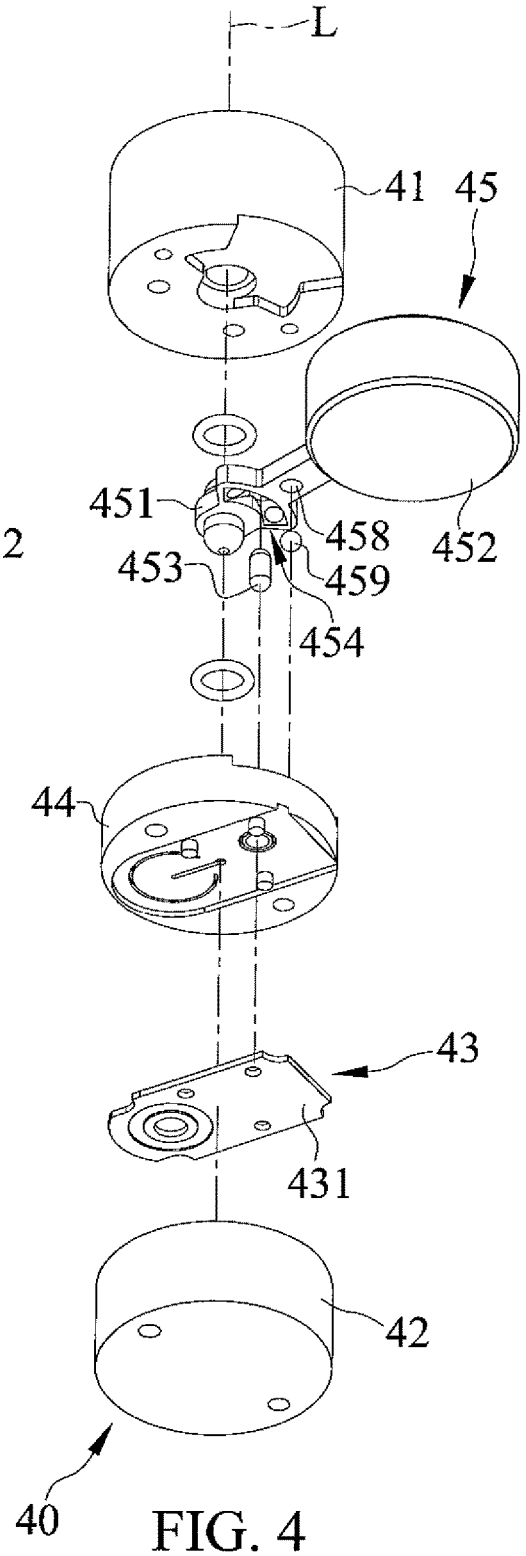
FIG. 4 is another exploded perspective view of the tilt safety device of the present invention, viewed from a different angle than that of FIG. 3.
Figure 5:
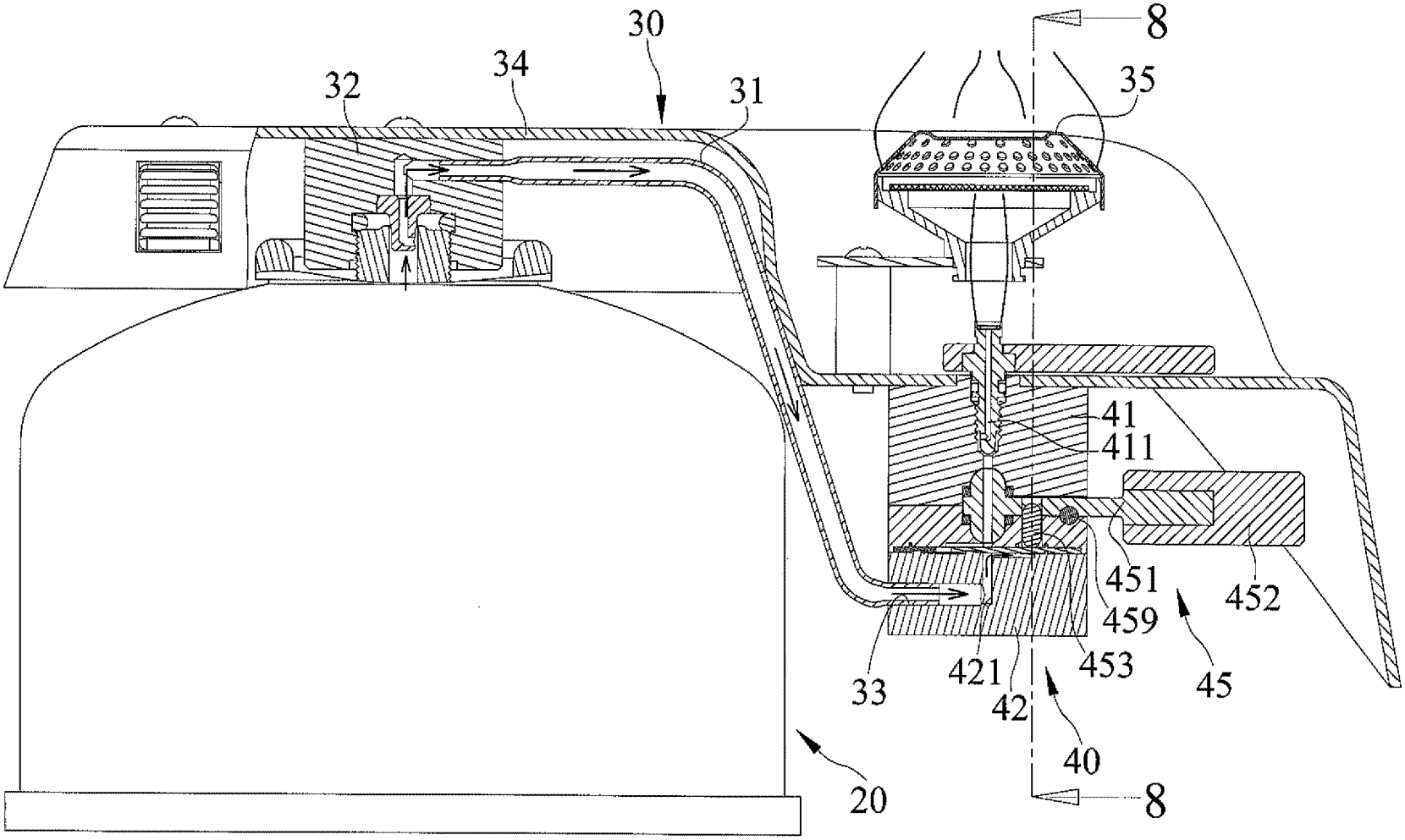
FIG. 5 is a cross-sectional view showing the gas burner with tilt safety assembly of the present invention in an operative position thereof allowing gas to flow and to produce a flame.
Figure 6:
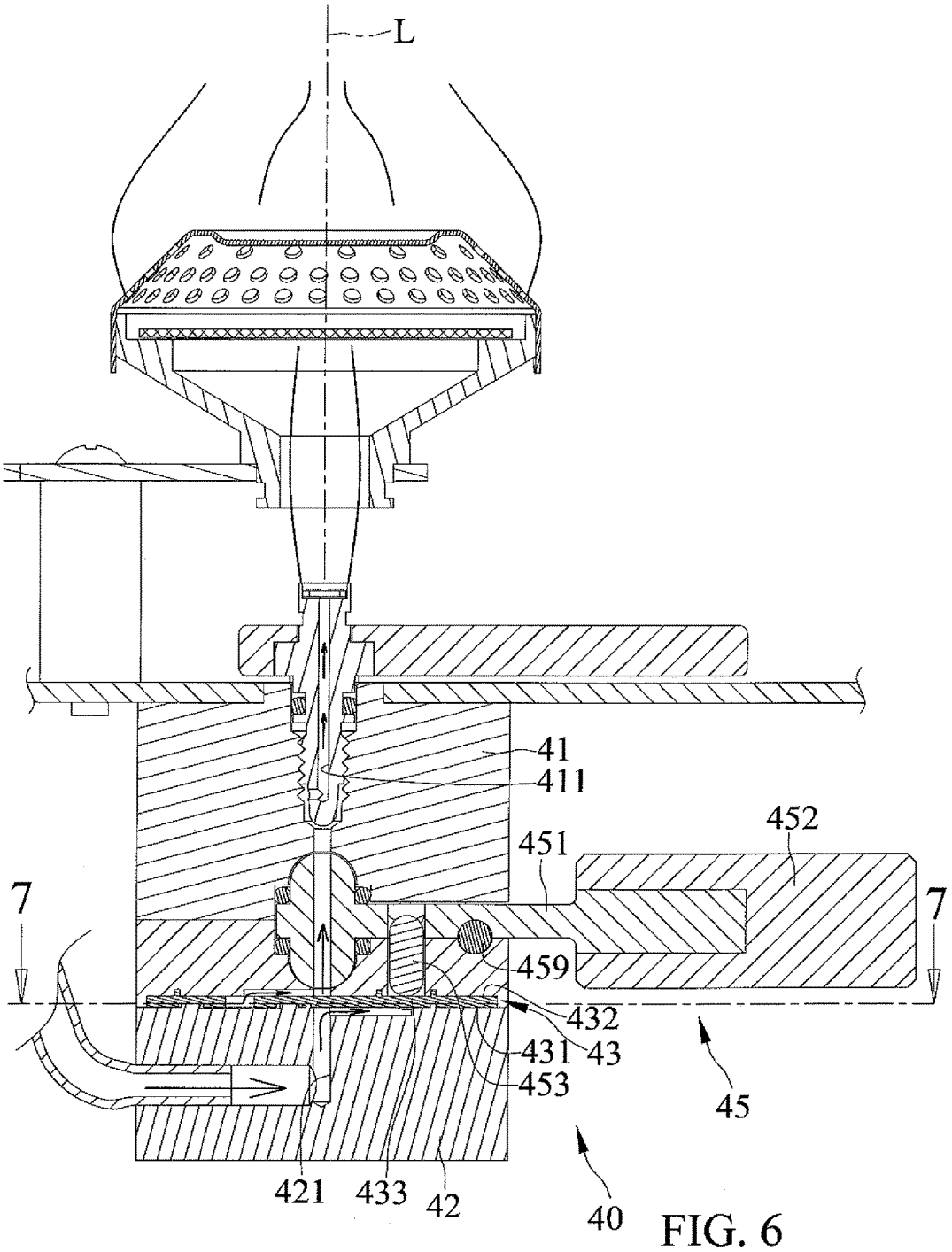
FIG. 6 is a partial, enlarged view of FIG. 5.
Figure 7:
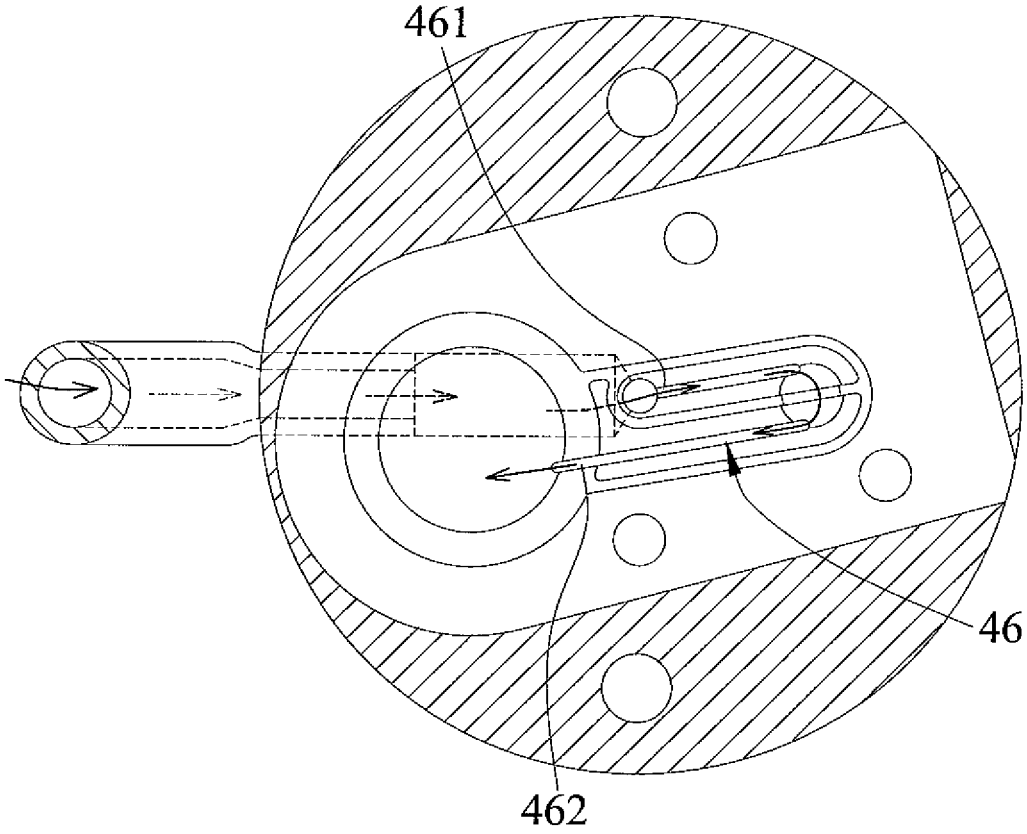
FIG. 7 is a cross-sectional view taken along line 7-7 of FIG. 6.
Figure 8:
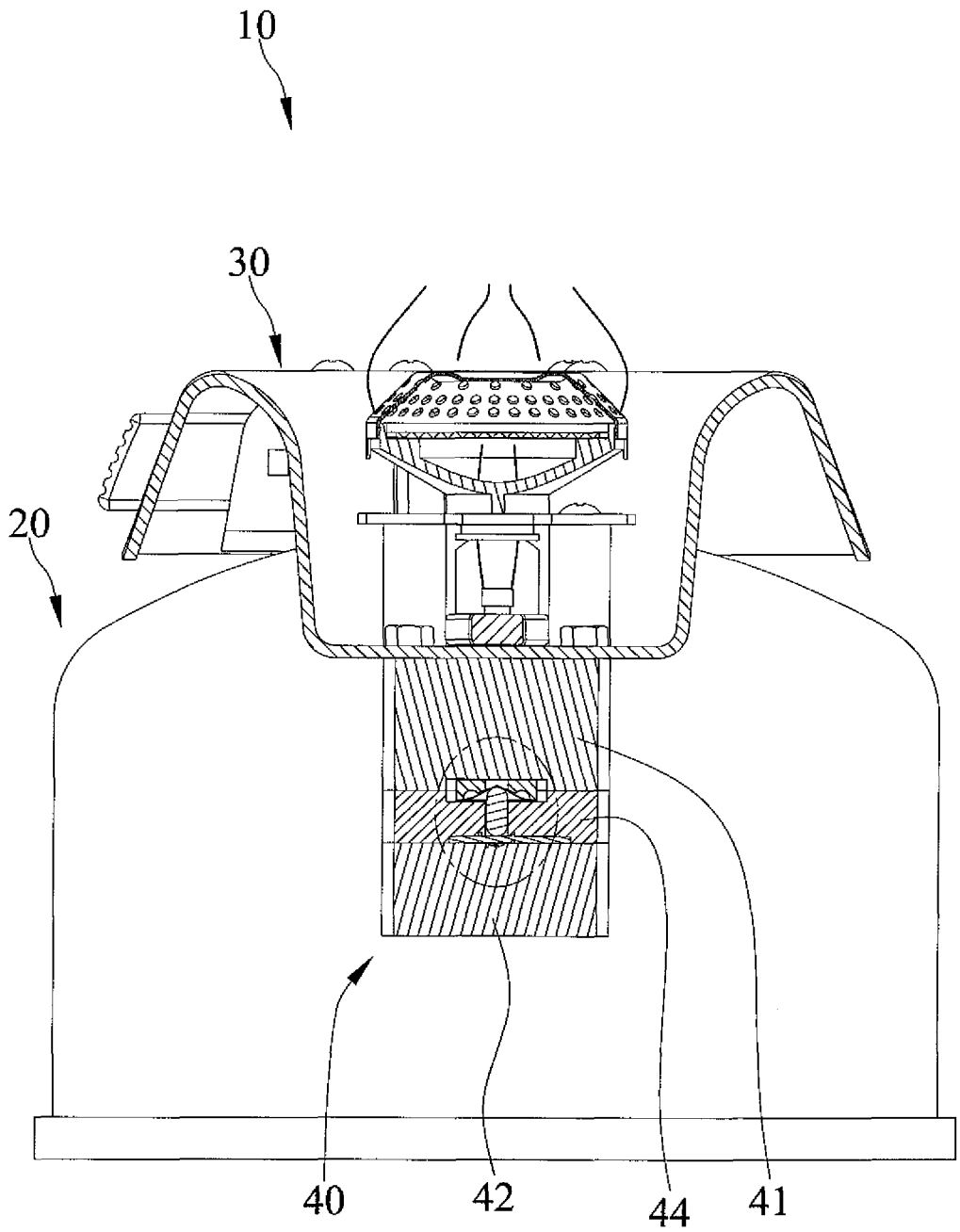
FIG. 8 is a cross-sectional view taken along line 8-8 of FIG. 5.
Figure 9:
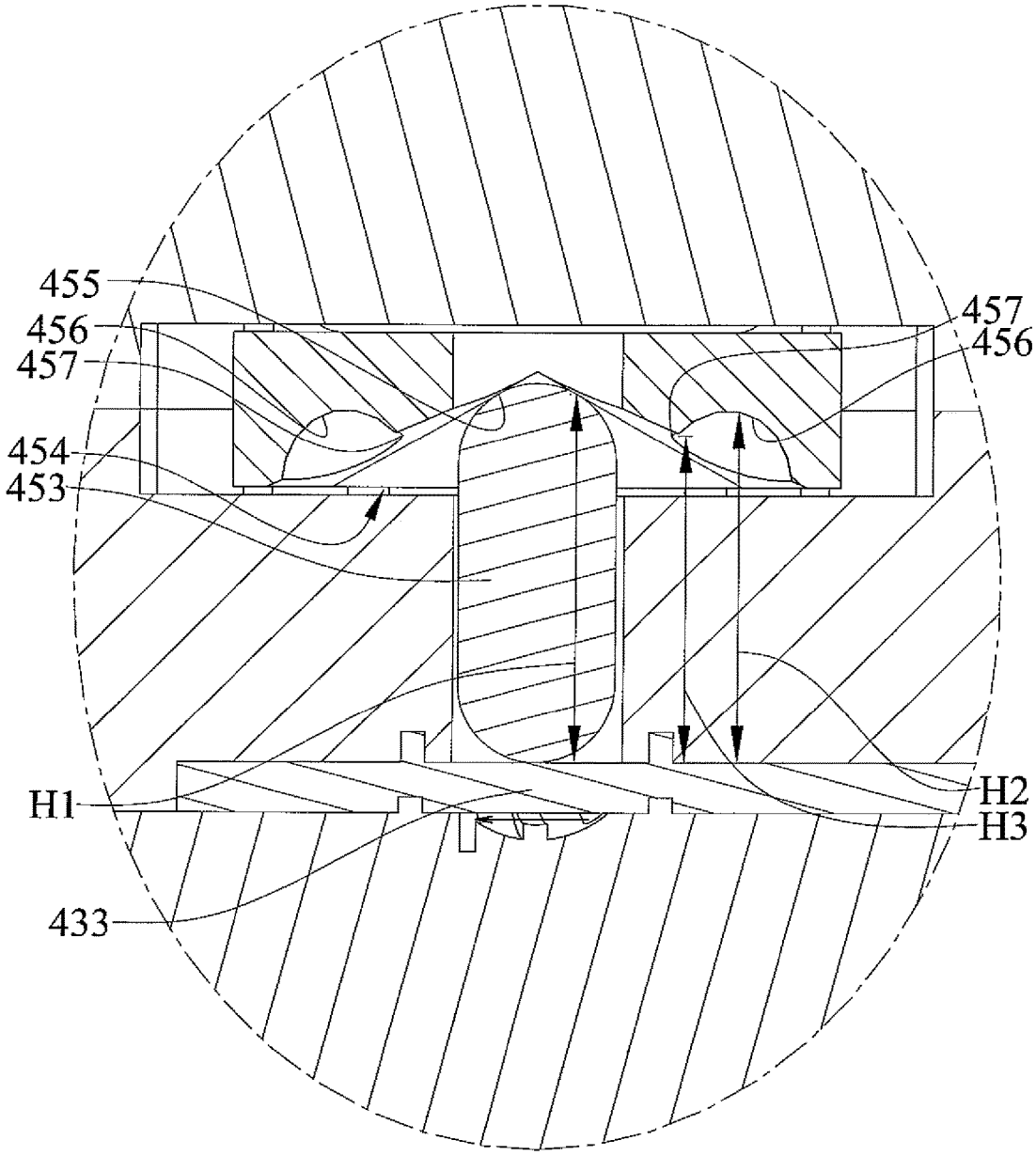
FIG. 9 is an enlarged, cross-sectional view of FIG. 8.

FIGS. 1 through 12 show a gas burner with tilt safety assembly 10 in accordance with the present invention includes a gas reservoir 20, a combustion device 30, and a tilt safety device 40.

The gas reservoir 20 has an outlet 23. The gas reservoir 20 has a top end 21 and a bottom end 22 distal to the top end 21. The gas reservoir 20 includes the top end 21 thereof forming the outlet 23.

The combustion device 30 includes a communication pipe 31. The communication pipe 31 fluidly connects to the gas reservoir 20. The communication pipe 31 extends inclinedly in a downward direction from the gas reservoir 20 to the tilt safety device 40. The communication pipe 31 has a first end 32 engaging with the outlet 23 of the gas reservoir 20. The second end 33 of the communication pipe 31 forms a joint structure fixable with the outlet 23 of the gas reservoir 20. The communication pipe 31 has a second end 33 defining an exit end. The communication pipe 31 is shielded in a casing 34. The combustion device 30 includes an ignition system 36 for gas ignition. The ignition system 36 includes a control input 361 and a spark electrode 362 connecting to the control input 361. The control input 361 is fixed on the casing 34. The spark electrode 362 is disposed outside the casing 34. The combustion device 30 includes a flame holder 35 for holding a flame of the gas with tilt safety assembly 10. The flame holder 35 includes a plurality of pores. The flame holder 35 is disposed outside the casing 34. The gas burner with tilt safety assembly 10 produces a flame burning in an upward direction, and the flame holder 35 is disposed above the first seat 41 in the upward direction. The gas burner with tilt safety assembly 10 produces a flame outside the casing 34 after ignition by the ignition system 36.

The tilt safety device 40 fluidly connects to the second end 33 of the communication pipe 31. The tilt safety device 40 includes a first seat 41. The first seat 41 is disposed at a height from the gas reservoir 20 lower than a height of the joint structure of the communication pipe 31 from the gas reservoir 20. The first seat 41 includes a first gas passage 411 extending longitudinally along a phantom axis L which extends in a vertical direction. The flame holder 35 fluidly connects to the first gas passage 411. The flame holder 35 is disposed adjacent to a fuel outlet port of the first gas passage 411. A second seat 42 bears the first seat 41. The second seat 42 connects to the second end 33 of the communication pipe 31. The communication pipe 31 extends inclinedly in a downward direction from the gas reservoir 20 to the second seat 42. The second seat 42 includes a second gas passage 421. The second gas passage 421 fluidly connects to the communication pipe 31. An elastomer 43 is disposed on the second seat 42. The elastomer 43 is disposed on a side of the second seat 42, which is adjacent to the first seat 41. The elastomer 43 has a bottom edge 431 adjacent to the second seat 42. The elastomer 43 has a top edge 432 distal to the second seat 42. The elastomer 43 includes a section defining a stop 433 extending between the top and bottom edges 431 and 432. A joint 44 is disposed between the first and second seats 41 and 42. The joint 44 includes a third gas passage 441. The third gas passage 441 extends through the joint 44. The joint 44 includes a hole 442. The hole 442 extends through the joint 44. The joint 44 includes a slot 443. The slot 443 does not extend through the joint 44. The slot 443 extends radially and annularly with respect to the phantom axis L. The third passage 441, the hole 442, and the slot 443 extend longitudinally along the phantom axis L. The tilt safety device 40 also includes a control mechanism 45. The control mechanism 45 includes a lever 451. The lever 451 has a first end disposed adjacent to the top edge 432 of the elastomer 43. The lever 451 has a second end extending away from the phantom line L. The lever 451 includes the first end thereof forming a connecting structure received in the third gas passage 441. At least one retainer ring engages with the connecting structure. The connecting structure includes a channel extending therein and fluidly connecting to the first gas passage 411. The lever 451 connects to a bob 452. The bob 452 is under gravity and is disposed outside the first and second seats 41 and 42. The lever 451 has a bottom edge thereof defining a contact region 454 against which a pusher 453 abuts. The contact region 454 includes the first, at least one second, and at least one third contact areas 455, 456, and 457. Each of the first, at least one second, and at least one third contact areas 455, 456, and 457 is in a form of a recess. The lever 451 includes the first contact area 455 and the at least one second contact area 456 selectively engaging with the pusher 453 which has an end engaging with the stop 433 and is received by the hole 442. The first contact area 455 spaces from the top edge 432 of the elastomer 43 at a first height H1. The at least one second contact area 456 spaces from the top edge 432 of the elastomer 43 at a second height H2 which is less than the first height H1. The at least one second contact area 456 includes two second contact areas 456. The two second contact areas 456 include the first contact area 455 extending therebetween. The at least one third contact area 457 is disposed at a junction between the first and the at least one second contact areas 455 and 456. The at least one third contact area 457 spaces from the top edge 432 of the elastomer 43 at a third height H3. The third height H3 is less than the second height H2. The at least one third contact area 457 includes two third contact areas 457. A gas flow channel 46 extends between the second seat 42 and the elastomer 43. The gas flow channel 46 and the second seat 42 are made from the same material and into a one-piece structure. The gas flow channel 46 has a first end 461 fluidly connecting to the second gas passage 421. The first end 461 fluidly connects to the third gas passage 441. The gas flow channel 46 has a second end 462 fluidly connecting to a hole extending through the elastomer 43 and the first gas passage 411. The gas flow channel 46 includes the first and second ends 461 and 462 thereof including the stop 433 disposed therebetween. A slider 459 connects to the lever 451 and is received by the slot 443. The lever 451 and the slider 459 are distinctly formed. The lever 451 includes a recess 458 restraining the slider 459. The slider 459 is in a form of a spherical object.

The first and second seats 41 and 42, the elastomer 43, the joint 44, and the control mechanism 45 are shielded in the casing 34. Therefore, the gas burner with tilt safety assembly 10 looks neater. The casing 34 shields and prevents the first and second seats 41 and 42, the elastomer 43, the joint 44, and the control mechanism 45 from getting dirty. The casing 34 also reduces heat loss.

The gas burner with tilt safety assembly 10 in an operative position thereof stands in an upright position and includes the lever 451 in a position that the first contact area 455 engages with the pusher 453 and the elastomer 43 is free of deformation. Therefore, the gas burner with tilt safety assembly 10 in the operative position thereof allows gas to flow and to produce a flame. The gas burner with tilt safety assembly 10 in an inoperative position thereof stands in a tilted position and includes the lever 451 in another position that the at least one second contact area 456 engages with the pusher 453 and the elastomer 43 deforms to abut the second seat 42 and blocks the gas flow channel 46. The lever 451 is swingable in a plane transverse to the phantom axis L. The lever 451 is swingable about the phantom axis L.

The pusher 453 can abut the at least one third contact area 457 when the lever 451 moves from the position that the first contact area 455 engages with the pusher 453 to the position that the at least one second contact area 456 engages with the pusher 453. The slider 459 is disposed at different positions of the slot 443 when the lever 451 is in the position that the first contact area 455 engages with the pusher 453 and the position that the at least one second contact area 456 engages with the pusher 453.

Figure 10:
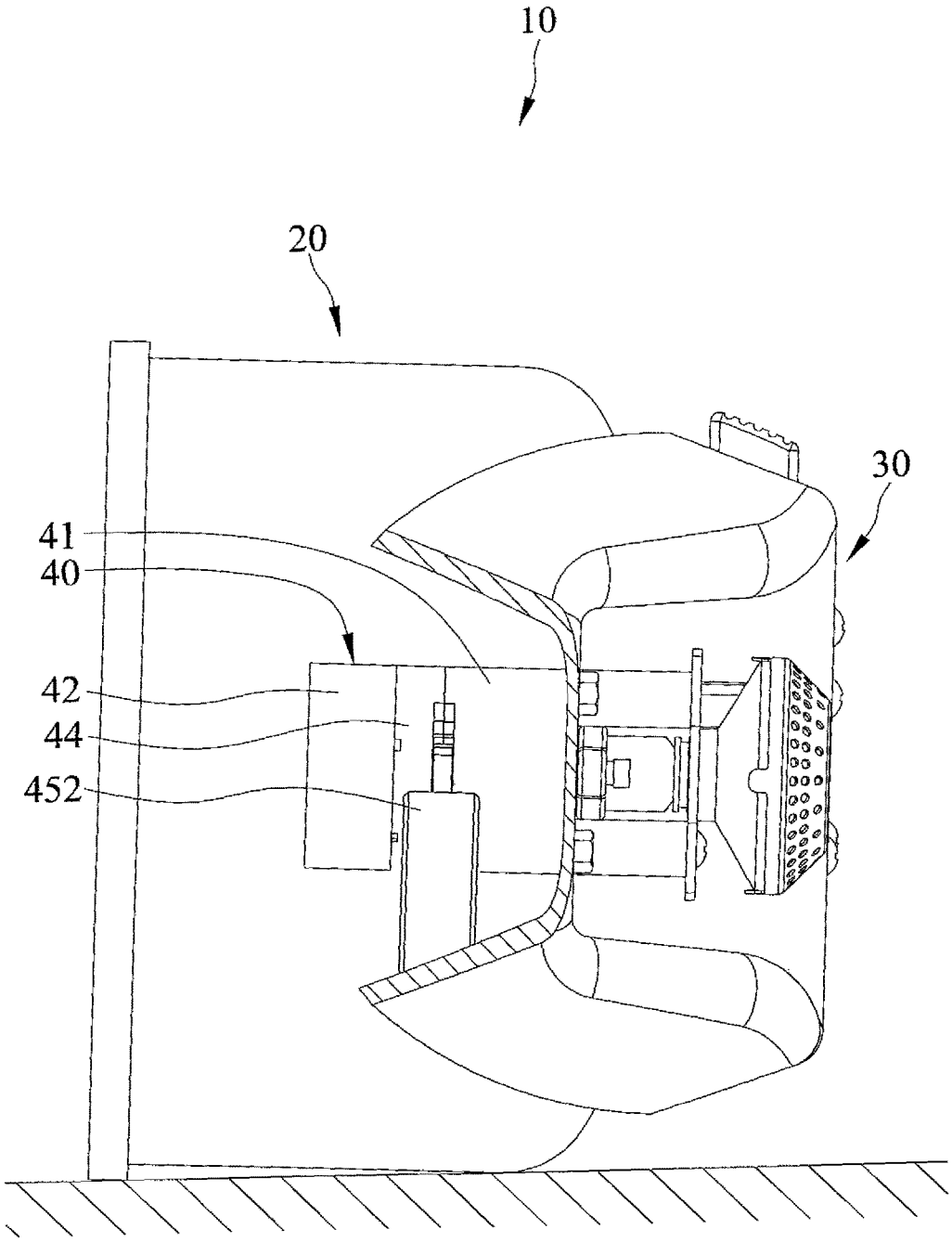
FIG. 10 is a cross-sectional view showing the gas burner with tilt safety assembly of the present invention in an inoperative position thereof stopping gas.
Figure 11:
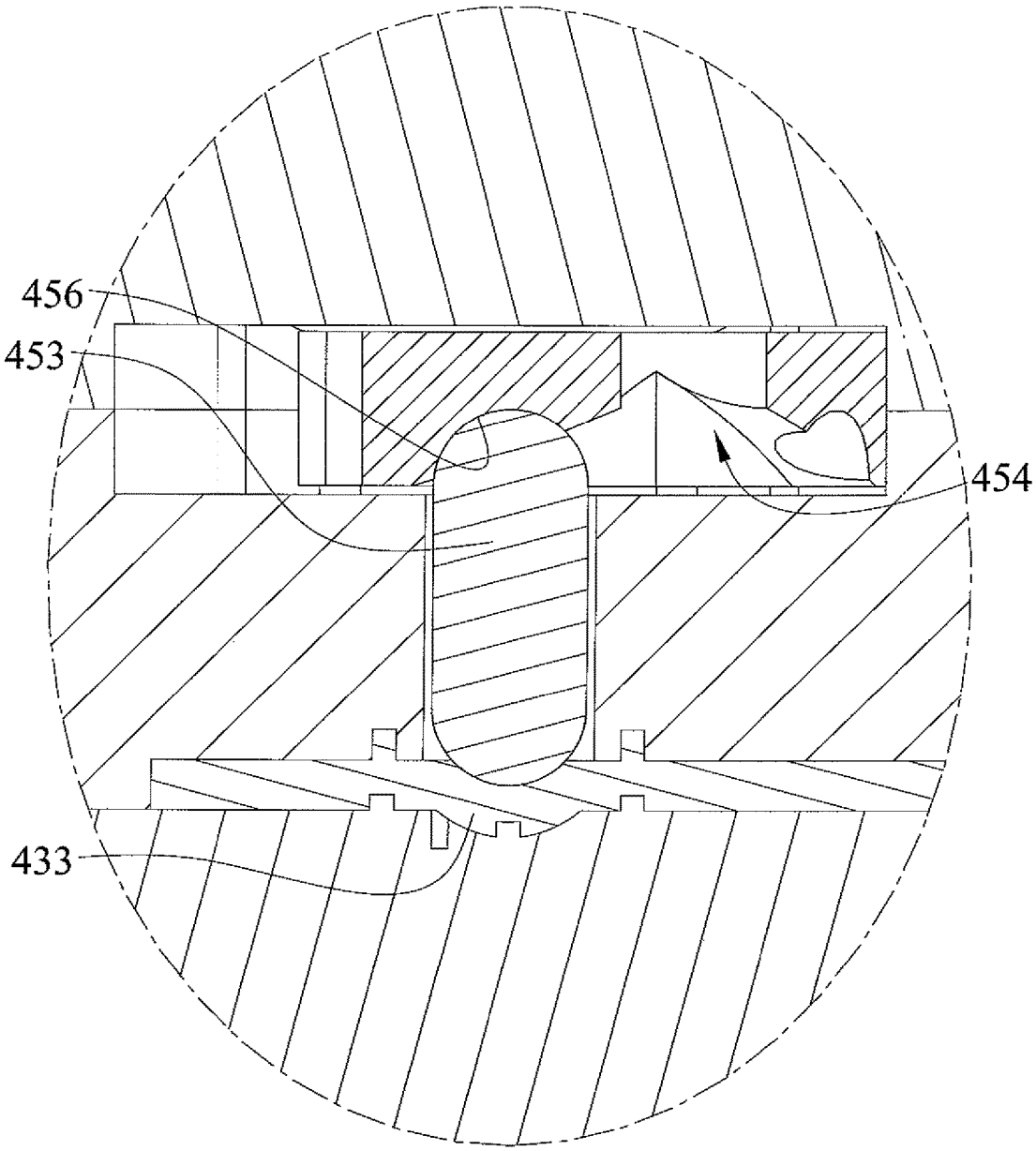
FIG. 11 is a cross-sectional view showing the gas burner with tilt safety assembly of the present invention in an inoperative position thereof stopping gas.
Figure 12:
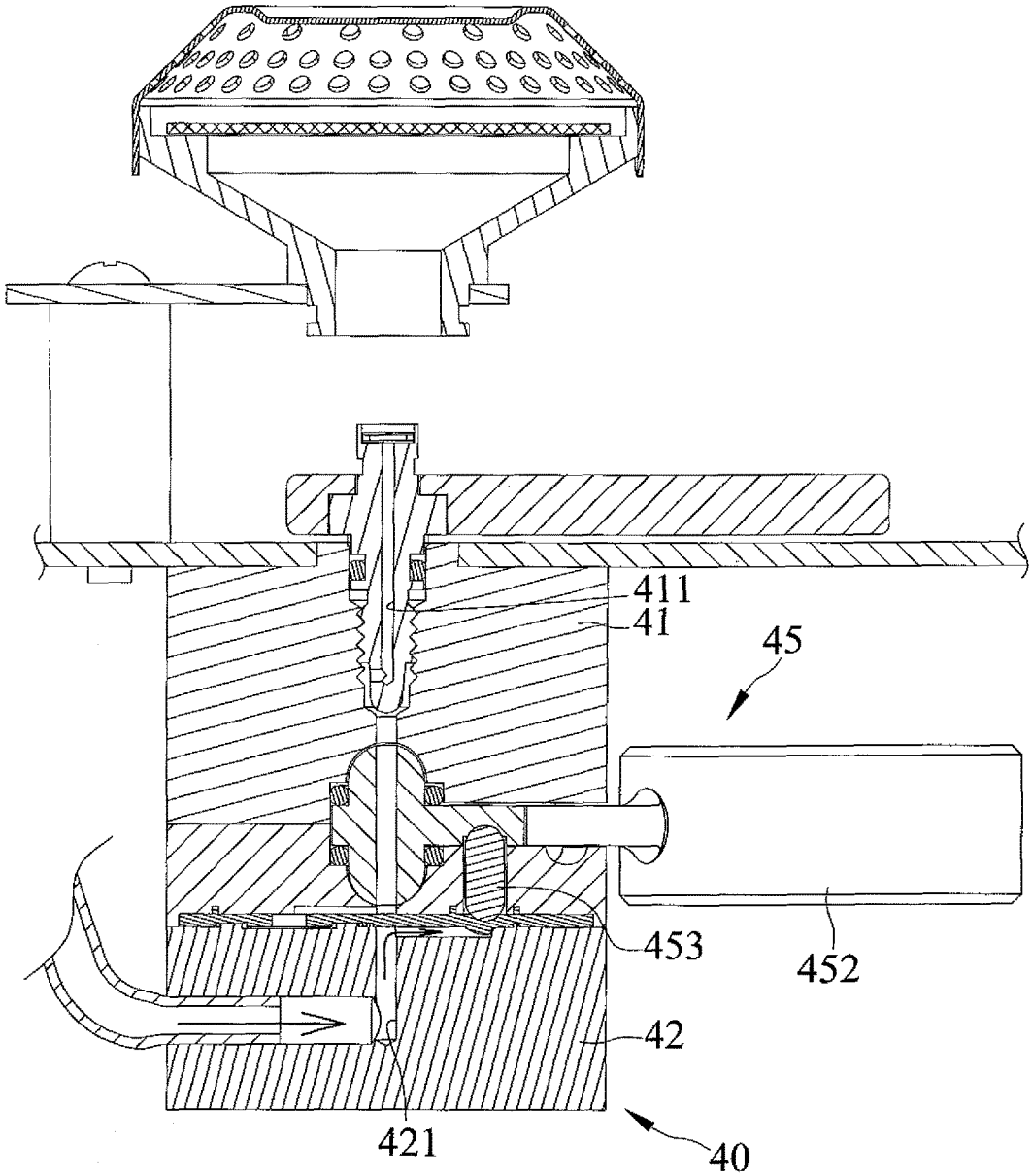
FIG. 12 is a cross-sectional view showing the gas burner with tilt safety assembly of the present invention tilted back to the operative position thereof, but the tilt safety device not yet returned to a position allowing gas to flow to the burner head.

FIG. 10 shows the gas burner with tilt safety assembly 10 in the inoperative position thereof that stops gas. The gas is stopped from flowing to the first gas passage 411. FIG. 12 shows the gas burner with tilt safety assembly 10 tilted back to the operative position thereof, but the tilt safety device 40 not yet returned to a position allowing gas to flow to the burner head. Therefore, a user has to return the tilt safety device 40 to the position that the first contact area 455 engages with the pusher 453 to continue gas delivery.

In addition, the first seat 41, which can correspond to the burner head in applicant's U.S. patent application Ser. No. 14/331,257 filed on Jul. 15, 2014, is disposed at a height from the gas reservoir 20 lower than a height of the joint structure of the communication pipe 31 from the gas reservoir 20. The first gas passage 411 of the first seat 41 also includes a valve, which allows gas in the first gas passage 411 to flow therethrough and controls the size of a flame of the gas burner with tilt safety assembly 10, engaging therein. Likewise, the gas burner with tilt safety assembly 10 can have an efficient combustion.

In view of the forgoing, the first gas passage 411 extends in a vertical direction. Therefore, the gas burner with tilt safety assembly 10 produces a flame going upwardly vertical direction. The first contact area 455 spaces from the top edge 432 of the stop 433 of the elastomer 43 at the first height H1. The second contact area 456 spaces from the top edge 432 of the stop 433 of the elastomer at the second height H2 which is less than the first height H1. The gas burner with tilt safety assembly 10 in the operative position thereof stands in an upright position and includes the lever 451 in the position that the first contact area 455 engages with the pusher 453 and the elastomer 43 is free of deformation. The gas burner with tilt safety assembly 10 in the inoperative position thereof stands in a tilted position and includes the lever 451 in another position that the at least one second contact area 456 engages with the pusher 453 and the elastomer 43 deforms to abut the second seat 42 and blocks the gas flow channel 46.

The foregoing is merely illustrative of the principles of this invention and various modifications can be made by those skilled in the art without departing from the scope and spirit of the invention.

What is claimed is:

1. A gas burner with tilt safety assembly comprising:

a tilt safety assembly comprising:

a combustion device including a communication pipe having a first end and a second end; and a tilt safety device fluidly connecting to the second end of the communication pipe, and including a first seat including a first gas passage extending longitudinally along a phantom axis which extends in a vertical direction, and including a second seat connecting to the second end of the communication pipe and bearing the first seat and including a second gas passage, and including an elastomer disposed on the second seat and having a bottom edge adjacent to the second seat and a top edge distal to the second seat and including a section defining a stop extending between the top and bottom edges, and including a control mechanism including a lever having a first end disposed adjacent to the top edge of the elastomer and a second end extending away from the phantom line and including a first contact area and at least one second contact area selectively engaging with a pusher which has an end engaging with the stop, with the first contact area spacing from the top edge of the elastomer at a first height and the at least one second contact area spacing from the top edge of the elastomer at a second height which is less than the first height, and including a gas flow channel extending between the second seat and the elastomer and having a first end connecting to the second gas passage and a second end connecting to a hole extending through the elastomer and the first gas passage and including the first and second ends thereof including the stop disposed therebetween;

wherein the gas burner with tilt safety assembly in an operative position thereof stands in an upright position and includes the lever in a position that the first contact area engages with the pusher and the elastomer is free of deformation; and wherein the gas burner with tilt safety assembly in an inoperative position thereof stands in a tilted position and includes the lever in another position that the at least one second contact area engages with the pusher and the elastomer deforms to abut the second seat and blocks the gas flow channel.

2. The gas burner with tilt safety assembly as claimed in claim 1, wherein the lever includes at least one third contact area spacing from the top edge of the elastomer at a third height less than the second height and disposed at a junction between the first and second contact areas.

3. The gas burner with tilt safety assembly as claimed in claim 2, wherein the at least one second contact areas includes two second contact areas, wherein the two second contact areas include the first contact area extending therebetween, and wherein the at least one third contact area include two third contact areas.

4. The gas burner with tilt safety assembly as claimed in claim 3 further comprising a joint disposed between the first and second seats, wherein the joint includes a third gas passage extending therethrough and fluidly connecting to the first end of the gas flow channel, and wherein the joint includes a hole extending therethrough and receiving the pusher.

5. The gas burner with tilt safety assembly as claimed in claim 4, wherein the lever includes the first end thereof forming a connecting structure received in the third gas passage, and wherein the connecting structure includes a channel extending therein and fluidly connecting to the first gas passage.

6. The gas burner with tilt safety assembly as claimed in claim 5 further comprising at least one retainer ring engaging with the connecting structure.

7. The gas burner with tilt safety assembly as claimed in claim 4, wherein the joint includes a slot receiving a slider connected to the lever.

8. The gas burner with tilt safety assembly as claimed in claim 7, wherein the lever and the slider are distinctly formed, and wherein the lever includes a recess restraining the slider.

9. The gas burner with tilt safety assembly as claimed in claim 7, wherein the slot extends radially and annular with respect to the phantom axis.

10. The gas burner with tilt safety assembly as claimed in claim 1, wherein the lever connects to a bob, and wherein the bob is disposed outside the first and second seats.

11. The gas burner with tilt safety assembly as claimed in claim 1 further comprising a casing, and wherein the communication pipe is shielded in the casing.

12. The gas burner with tilt safety assembly as claimed in claim 11, wherein the first and second seats, the elastomer, the joint, and the control mechanism are shielded in the casing.

13. The gas burner with tilt safety assembly as claimed in claim 1, wherein the combustion device includes an ignition system for ignition of fuel.

14. The gas burner with tilt safety assembly as claimed in claim 13, wherein the ignition system includes a control input and a spark electrode connecting to the control input.

15. The gas burner with tilt safety assembly as claimed in claim 14 further comprising a flame holder for holding a flame, wherein the flame holder fluidly connect to the first gas passage, and wherein the flame holder is disposed adjacent to a fuel outlet port of the first gas passage.

16. The gas burner with tilt safety assembly as claimed in claim 1, wherein the first seat is disposed at a height from a gas reservoir, which connects to the gas burner, lower than a height of a joint structure of the communication pipe connecting to the gas reservoir.

* * * * *